US005490332A

United States Patent [19]

Levin

[11] Patent Number: 5,490,332

[45] Date of Patent: Feb. 13, 1996

[54] EXTENDABLE GUTTING KNIFE

[76] Inventor: John M. Levin, 412 Fairview Rd., Narberth, Pa. 19072

[21] Appl. No.: 208,510

[22] Filed: Mar. 9, 1994

[51] Int. Cl.[6] ..... B26B 1/06

[52] U.S. Cl. ..... 30/161; 30/160; D22/118

[58] Field of Search ..... 30/155, 157–161; D22/118

[56] References Cited

U.S. PATENT DOCUMENTS

| | | | |
|---|---|---|---|
| 217,623 | 7/1879 | Leonard . | |
| D. 344,006 | 2/1994 | Glesser | D22/118 X |
| 684,016 | 10/1901 | Weidknecht . | |
| 770,118 | 9/1904 | Rowland . | |
| 947,980 | 2/1910 | Romano | 32/158 |
| 1,265,723 | 5/1918 | Bader . | |
| 1,788,656 | 1/1931 | Brown . | |
| 2,906,021 | 9/1959 | Cromoga . | |
| 3,839,788 | 10/1974 | Addis . | |
| 4,893,409 | 1/1990 | Poehlmann | 30/161 |
| 5,125,157 | 6/1992 | Howard | 30/161 X |

*Primary Examiner*—Douglas D. Watts

*Attorney, Agent, or Firm*—Caesar, Rivise, Bernstein, Cohen & Pokotilow, Ltd.

[57] ABSTRACT

A hunting knife with a retaining member with dull sides located beneath the handle into which the blade can be retracted. This enables the knife to be handled safely, and to be placed in a holster without any sharp protruding edges which can damage the holster. Further, when the blade is extended, the dull sides of the retaining member do not damage animal organs or tissues away from the gutting area which makes it more efficient and easier to use. A keeper mechanism firmly locks the blade in its extended or retracted positions.

23 Claims, 4 Drawing Sheets

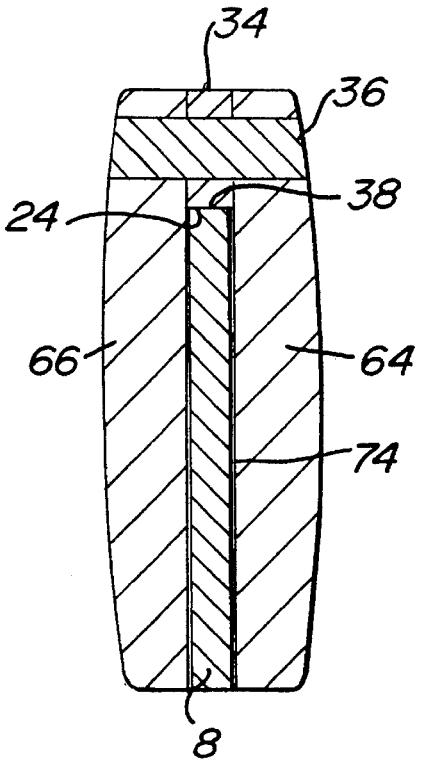
FIG. 3
FIG. 4
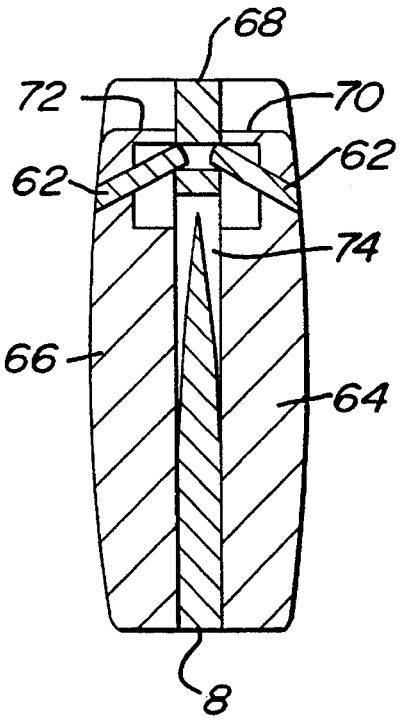
FIG. 5
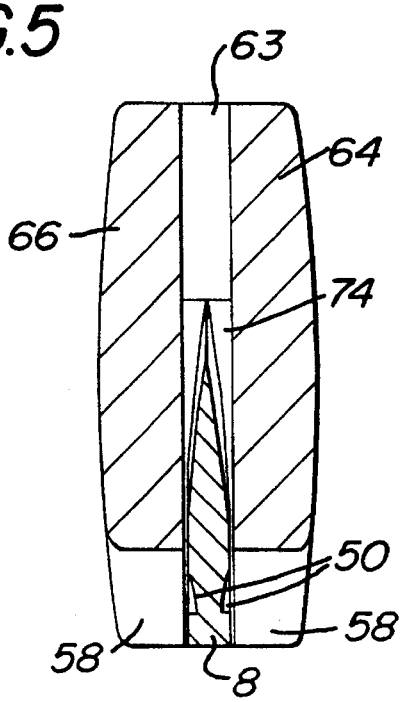

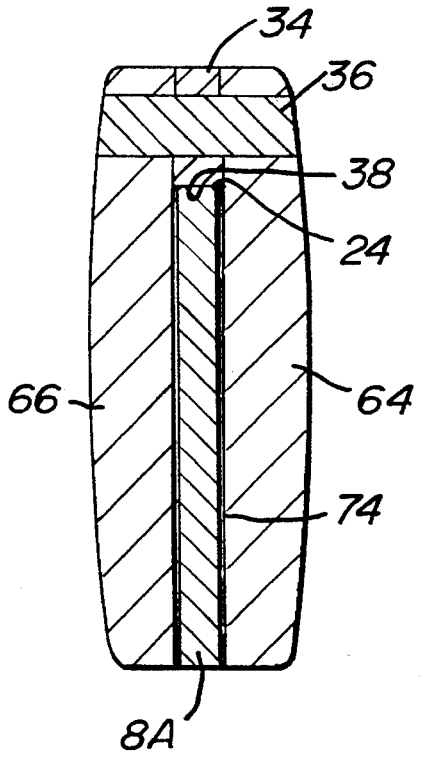
FIG.8
FIG.9
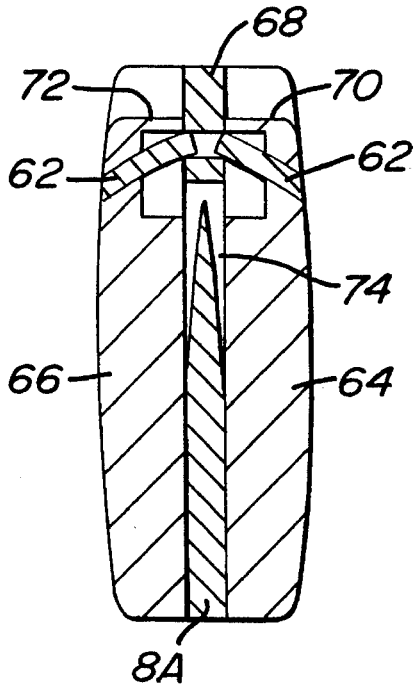
FIG.10
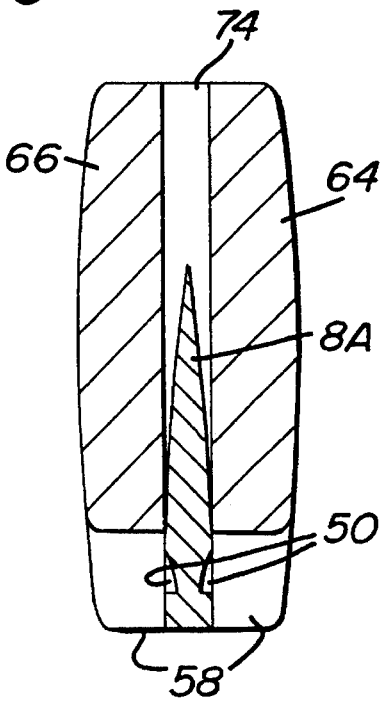

EXTENDABLE GUTTING KNIFE

BACKGROUND OF THE INVENTION

This invention relates generally to hunting or gutting knives, and more particularly to a gutting knife which is retractable into a retaining member located beneath the handle and which can be carried safely in a holster.

Various types of knives with retracting blades are known. Pocket knives with retractable blades are disclosed in U.S. Pat. No. 217,623 (Leonard); and U.S. Pat. No. 684,016 (Weidknecht). A pocket knife with a retractable blade for fisherman for disgorging hooks and removing scales is disclosed in U.S. Pat. No. 1,788,656 (Brown). Other patents which disclose skinning or gutting knives with retractable blades include U.S. Pat. No. 2,906,021 (Cromoga) and U.S. Pat. No. 3,839,788 (Addis).

Knives with retractable blades and guards which fold into the handles are disclosed in U.S. Pat. No. 770,118 (Rowland) and U.S. Pat. No. 1,265,723 (Bader).

However, none of these patents disclose a hunting or gutting knife with an intermediate member between the handle and the blade into which the blade retracts, enabling the knife to be carried safely in a standard holster, and to be of extended length when in use.

OBJECTS OF THE INVENTION

Accordingly, it is the general object of the instant invention to provide a gutting knife which improves upon and overcomes the limitations of existing gutting knives.

It is a further object of the instant invention to provide a gutting knife which can be carried in a standard holster.

It is yet a further object of the instant invention to provide a gutting knife which can be safely inserted and removed from the holster without any exposed sharp edges.

It is still yet a further object of the instant invention to provide a gutting knife which can be carried in a standard holster and which is extendable in length after it has been removed from the holster.

It is another object of the instant invention to provide a gutting knife with a retaining member, for holding a retractable blade, which is structured to provide for ease of cleaning.

It is still another object of the instant invention to provide a gutting knife with a locking mechanism which prevents movement of the blade from its extended or retracted positions.

It is still yet another object of the instant invention to provide a gutting knife with an easy means to unlock the blade from its extended or retracted positions.

It is an additional object of the instant invention to provide a gutting knife with a retaining member having dull edges to allow for gutting an animal without damaging organs or tendons, away from the area being gutted.

SUMMARY OF THE INVENTION

These and other objects of the instant invention are achieved by providing an extendable gutting knife which comprises a handle and a blade retaining member between the handle and the blade. When the blade is retracted into the blade retaining member, no sharp edges are exposed, and the blade can be safely inserted, removed from, and carried in the holster. The blade retaining member has a keeper which locks the blade into its extended or retracted position and it has an open through slot for easy cleaning after the knife has been used.

DESCRIPTION OF THE DRAWING

Other objects and many of the intended advantages of this invention will be readily appreciated when the same becomes better understood by reference to the following detailed description, when considered in connection with the accompanying drawings wherein:

FIG. 3 is a sectional view of the gutting knife taken along the line 3—3 of FIG. 1;

FIG. 4 is a sectional view of the gutting knife taken along the line 4—4 of FIG. 1;

FIG. 5 is a sectional view of the gutting knife taken along the line 5—5 of FIG. 1;

FIG. 8 is a sectional view of the alternative embodiment of the gutting knife taken along the line 8—8 of FIG. 6;

FIG. 9 is a sectional view of the alternative embodiment of the gutting knife taken along the line 9—9 of FIG. 6; and FIG. 10 is a sectional view of the alternative embodiment of the gutting knife taken along the line 10—10 of FIG. 6.

DETAILED DESCRIPTION OF THE PREFERRED EMBODIMENTS

Figure 1:
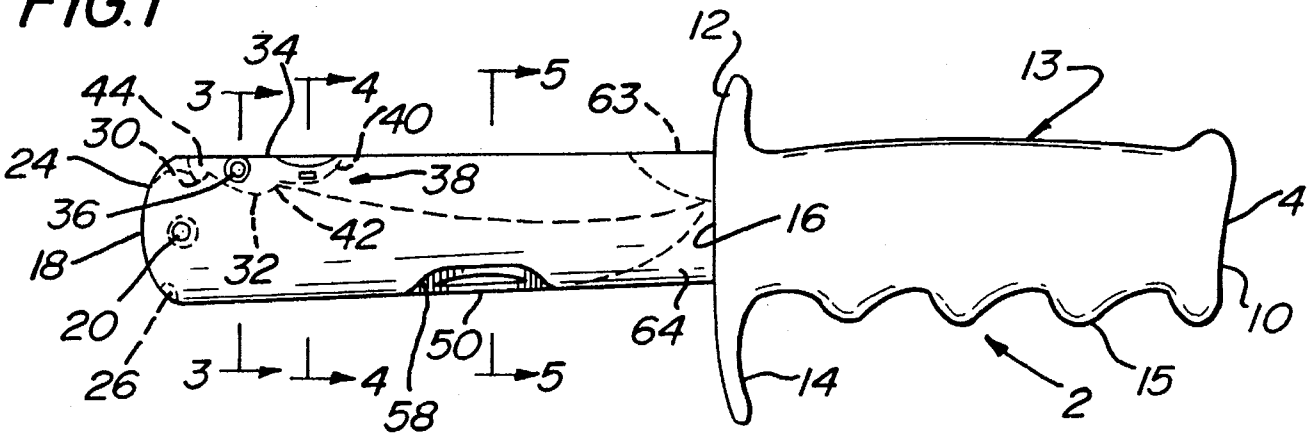
FIG. 1 is a side view of the gutting knife with the blade in its retracted position.
Figure 2:
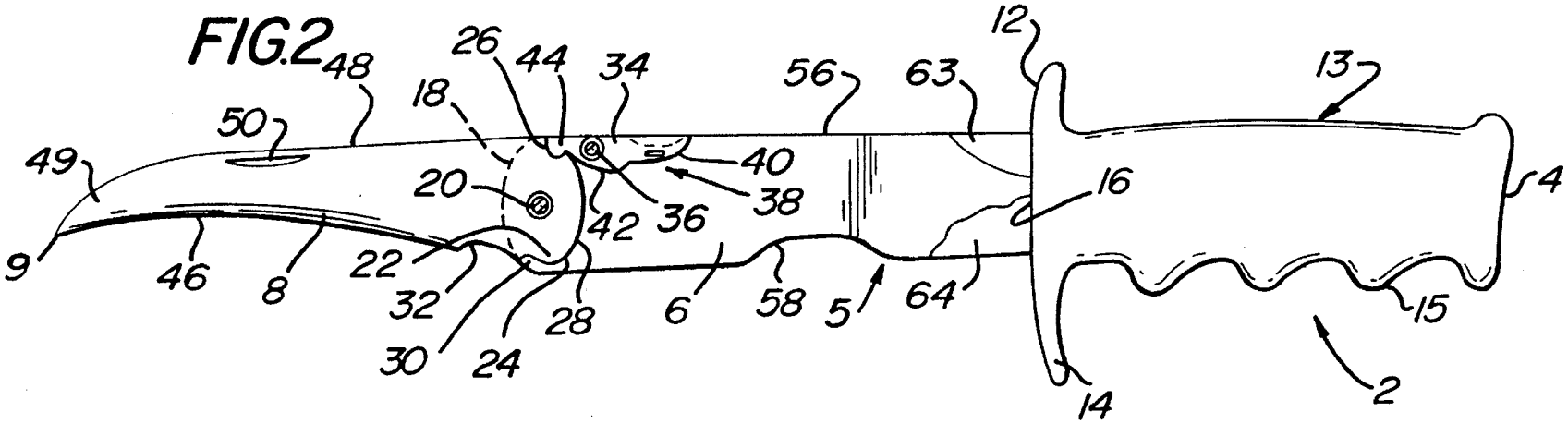
FIG. 2 is a side view of the gutting knife with the blade in its extended position, and the wall of the retaining member removed to show details of construction of the blade and internal details of construction of the retaining member.

Referring now in greater detail to the various figures of the drawing, wherein like reference characters refer to like parts, the extendable gutting knife 2 of the instant invention is shown in FIGS. 1 and 2. The knife 2 comprises a handle 4, and a blade section 5. The blade section 5 has a blade retaining member 6, and a blade 8. The handle 4 has a free proximal end 10 and a distal end 12 with a hand guard 14 positioned at said distal end 12. The handle 4 also comprises an outer relatively flat surface 13 and an inner escalloped surface 15. The shape of the inner surface 15 is designed for ease in holding the handle 4 by the fingers of the user. The approximate dimensions of the knife in length may be 4 to 6 inches each for the retaining member 6, the handle 4 and the blade 8, and ½ inch for the hand guard 14, although in the preferred embodiment, the retaining member 6, the handle 4 and the blade 6 are approximately 5 inches in length.

The blade retaining member 6 comprises a proximal end 16 which is connected to the distal end 12 of the handle 4, and a distal end 18. The blade 8 is pivotably connected to the blade retaining member 6 via a pivot 20 which is emplaced in the blade retaining member 6 adjacent the distal end 18 of the blade retaining member 6. The blade 8 has a proximal end 22 which comprises a cammed surface 24. The cammed surface 24 has a first concave segment 26, a second convex segment 28, a third concave segment 30, and a fourth concave segment 32.

The blade retaining member 6 also comprises a keeper 34 which is pivotably connected to the blade retaining member 6 via a pivot 36 mounted in the blade retaining member 6 adjacent the distal end 18 of the blade retaining member 6. The keeper 34 has a cammed surface 38 which comprises a first convex segment 40, a second convex segment 42 and a third convex segment 44.

Referring to FIG. 1, which shows the blade 8 in its retracted position, it can be seen, that the cammed surface 24 meshes closely with the cammed surface 38 to hold the blade 8 secure in its retracted position. Convex segments 42 and 44 of the cammed surface 38 of the keeper 34 mesh with the concave segments 32 and 30, respectively, of the cammed surface 24 of the blade. This provides positive locking of the blade in its retracted position.

Referring now to FIG. 2, wherein the blade is shown in its extended position, the keeper 34 locks the blade 8 in its extended position by the meshing of the third convex segment 44 of the keeper 34 with the first concave segment 26 of the blade 8. Thus, the blade 8 also is firmly locked into its extended position.

The blade 8 further comprises a curved cutting inner edge 46, a generally straight dull outer edge 48 and a distal end 49. As can be seen in FIG. 2, the curved cutting inner edge 46 and the curved distal end 49 of the blade 8 converge to a point 9 at the end of the blade. The hook-like shape of the blade 8 is designed to facilitate its use as a skinning and gutting instrument in hunting.

The blade retaining member 6 further comprises an inner, dull (i.e., non-sharp) side 54 and a dull outer side 56 with an indentation 58 in the inner side 54. The blade 8 also comprises a fingernail grip 50 positioned adjacent its dull outer edge 48. As can be seen in FIG. 1, when the blade 8 is retracted, the fingernail grip 50 is positioned in the recess 58 making the fingernail grip accessible to the user for extending the blade. The blade retaining member 6 also includes a holding member 63 against which the point 9 rests when the blade is in its retracted position.

The inner and outer sides 54 and 56 of the retaining member are made dull so that when an animal is gutted, organs and body tissues away from the area being gutted will not be cut, torn or damaged as with existing gutting knifes. In addition, the dull sides 54 and 56 allow for safe handling when the blade is retracted and will not damage the holster when the knife is holstered.

Referring now to FIGS. 3–5, it can be seen that the blade retaining member 6 comprises side members 64 and 66. The side members 64 and 66 define an open through slot 74 into which the blade 8 is placed when the blade is in its retracted position. This open through slot 74 provides a distinct advantage over other knives with retractable blades in that the blade retaining member 6 can be easily cleaned of dirt, debris and other material after the blade has been used, by merely flushing water through it. Moreover, any debris retained on the cutting edge will not be packed against any surface of the retaining member 6 abutting the cutting edge, because no such surface is present.

FIG. 3 shows the keeper 34 positioned between the side walls 64 and 66. The pivot 36, about which the keeper 34 rotates, is positioned in the side walls 64 and 66. As stated previously, the closely abutting cammed surfaces 38 and 24 keep the blade 8 securely locked into its retracted position.

The mechanism for releasing the blade 8 from its retracted position, to its extended position, and from its extended position, to its retracted position will now be discussed. Referring to FIG. 4, it can be seen that the keeper 34 has a release lever 68 which is connected to a leaf spring 62. The side walls 64 and 66 have shoulders 70 and 72, respectively, which hold the release lever 68 into position. Depressing the release lever 68 rotates the keeper 34 about the pivot 36 causing the blade 8 to rotate about its pivot 20 and free the blade from its locked retracted position to its extended position when the fingernail grip 50 is grasped and pulled (FIGS. 1 and 2). The outer side 56 of the blade retaining member 6 has an indentation 60 which allows access of the release lever to the user. Similarly, depressing the release lever 68 will cause the keeper 34 to rotate about the pivot 36 which will free the blade 8 from its locked, extended position and enable the user to rotate the blade 8 into its retracted position.

FIG. 5 shows the upper portion of the blade 8 in the retracted position with the fingernail grip 50 of the blade. The contact between the knife point 9 and the holding member 63 is also shown.

An alternative embodiment of the knife is shown in FIGS. 6–10. The only differences between the first embodiment and the alternative embodiment is the shape of the blade 8, which is concave in the first embodiment and is convex in the second embodiment, and the shape of the holding member 63. The reference numbers for FIGS. 6–10 for similar or identical parts, are the same as the reference numbers used in FIGS. 1–5 of the first embodiment. Where parts are not the same, the postscript A is used. Except for the shape of the blade and the holding member, the structure of the knife 2A of the second embodiment, FIGS. 6–10, is the same as the structure of the knife 2 of the first embodiment FIGS. 1–5. The keeper 34 of the second embodiment is structured and operates identically the same as the keeper 34 of the first embodiment.

Figure 6:
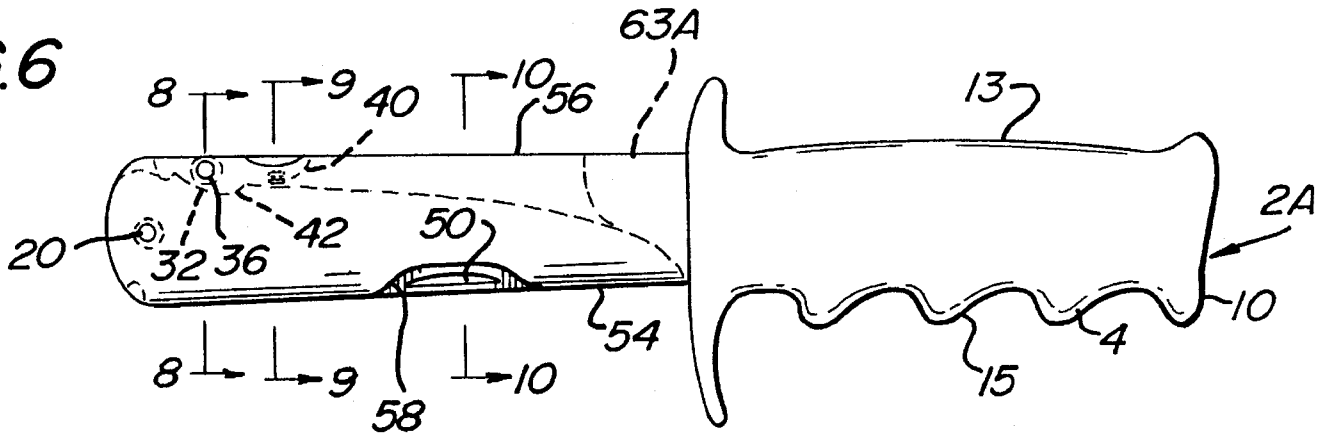
FIG. 6 is a side view of an alternative embodiment of the gutting knife with the blade in its retracted position.
Figure 7:
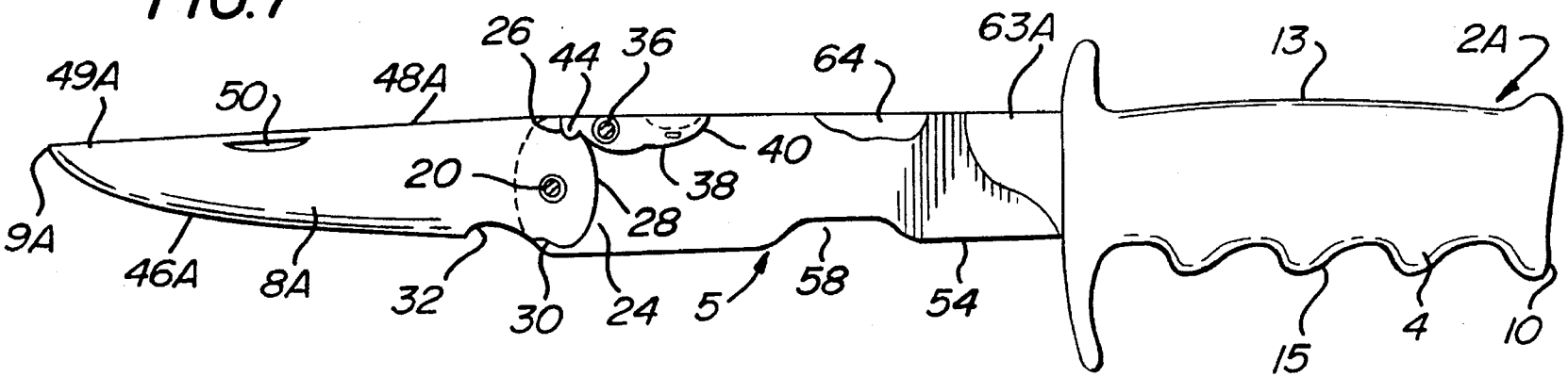
FIG. 7 is a side view of the alternative embodiment of the gutting knife with the blade in its extended position, and the wall of the retaining member removed to show details of construction of the blade and internal details of construction of the retaining member.

Therefore, only the differences between the first and second embodiments need be discussed herein. Referring now to FIGS. 6–7, the blade 8A has a curved inner cutting edge 46A and a generally straight dull outer edge 48A. As can be seen in the figures, the curved cutting inner edge 46A is slightly convex and the straight outer edge 48A does not have a curved portion near its distal end 49A as does the knife 2 of the first embodiment. The shape of the blade 8A is that of a conventional knife blade.

The holding member 63A is shaped to accept the blade 8A as opposed to the holding member 63 of the first embodiment which was shaped to accept the hook blade 8.

The blade of the first embodiment has a hook shape with a sharp point which is specifically designed as a gutting instrument. The blade of the second embodiment has a conventional shape which can be used for hunting as well as for more general purposes. Although in these embodiments, the blades are shown with smooth cutting edges, it should be kept in mind that the edges of the blades can be serrated.

An extendable hunting knife has been described which has several important advantages over the prior art. When the blade of the knife is retracted, it can be safely handled and placed or removed from the holster with no sharp edges exposed which can result in injury to the user or damage to the holster. Further, when used with a standard holster, the knife has an extended length, which makes it easier and more efficient to use for gutting or other purposes than conventional hunting knives. For gutting, the dull sides of the retaining member will not tear, cut or damage organs or tissues away from the gutting area as do other gutting knives. Finally, the open structure, i.e., the open through slot between the side members 64 and 66 into which the retracted blade is set, makes it easy to clean the knife of debris, waste or other material after use. An important safety feature of the knife is the keeper 34 which positively locks the knife into its extended and retracted positions. Releasing the blade from its extended or retracted positions is facilitated by the release lever 68 which can be operated by a finger of the user.

Without further elaboration, the foregoing will so fully illustrate my invention, that others may, by applying current or future knowledge, readily adapt the same for use under the various conditions of service.

I claim:

1. A knife comprising a handle, with a handguard, a retractable and extendable blade, a blade retaining member independent of said handle and having a length equal to at least the length of said blade and having a first and a second end, said handle being connected to said retaining member at said first end, and means for retracting and extending said blade comprising a first pivot at said second end, to which said blade is connected said retaining member comprising a slot therein into which said entire blade is retracted, and said blade being distanced apart from said handle by approximately the length of said retaining member when said blade is extended.

2. The knife of claim 1 wherein said blade is hook-shaped forming a sharp point at said third distal end.

3. The knife of claim 2 wherein said retractable blade retaining member comprises a first side member and a second side member, said side members forming a slot between them into which said blade can be retracted, said slot extending completely through said blade retaining member.

4. The knife of claim 3 further comprising means for locking said retractable blade in its retracted position in said blade retaining member or into its extended position.

5. The knife of claim 4 wherein said means for locking said retractable blade comprises a keeper and means for pivotably coupling said keeper to said blade retaining member, said coupling means comprising a second pivot.

6. The knife of claim 5 wherein said keeper has a first cammed surface and said blade has a second cammed surface which mates with said first cammed surface when said blade is in said retracted and in said extended positions.

7. The knife of claim 6 wherein said keeper further comprises a means for releasing said blade from said retracted and extended positions.

8. The knife of claim 7 wherein said blade retaining member comprises an inner side and an outer side and said means for releasing said blade comprises a release lever and means for providing access to said release lever, said means for providing access comprising a recess in said outer side and a leaf spring mounted in said side walls and in contact with said release lever.

9. The knife of claim 8 wherein said blade comprises an inner cutting edge, an outer dull edge and a fingernail grip positioned adjacent said outer dull edge, and said knife further comprises means for accessing said fingernail grip when said blade is in said retracted position, said means for accessing said fingernail grip comprising a recess in said inner side of said blade retaining member.

10. The knife of claim 9 wherein said handle further comprises a hand grip.

11. The knife of claim 1 wherein said blade comprises a convex shaped inner cutting edge.

12. The knife of claim 11 wherein said retractable blade retaining member comprises a first side member and a second side member, said side members forming a slot between them into which said blade can be retracted, said slot extending completely through said blade retaining member.

13. The knife of claim 12 further comprising means for locking said retractable blade in its retracted position in said blade retaining member or into its extended position.

14. The knife of claim 13 wherein said locking means comprises a keeper and means for pivotably coupling said keeper to said blade retaining member, said coupling means comprising a second pivot.

15. The knife of claim 14 wherein said keeper has a first cammed surface and said third proximal end of said blade has a second cammed surface which mates with said first cammed surface when said blade is in said retracted and in said extended positions.

16. The knife of claim 15 wherein said keeper further comprises a means for releasing said blade from said retracted and extended positions.

17. The knife of claim 16 wherein said blade retaining member comprises an inner side and an outer side and said means for releasing said blade comprises a release lever and means for providing access to said release lever, said means for providing access comprising a recess in said outer side and a leaf spring mounted in said side walls and in contact with said release lever.

18. The knife of claim 17 wherein said blade further comprises a fingernail grip positioned adjacent said dull edge, and said knife further comprises means for accessing said fingernail grip when said blade is in said retracted position, said means for accessing said fingernail grip comprising a recess in said inner side of said blade retaining member.

19. The knife of claim 18 wherein said handle further comprises a hand grip,

20. The knife of claim 3 wherein said handle, said blade and said retaining member are each approximately 4 to 6 inches in length and said handguard is approximately ½ inch in length.

21. The knife of claim 3 wherein said handle, said blade and said retaining member are each approximately 5 inches in length and said handguard is approximately ½ inch in length.

22. The knife of claim 12 wherein said handle, said blade and said retaining member are each approximately 4 to 6 inches in length and said handguard is approximately ½ inch in length.

23. The knife of claim 12 wherein said handle, said blade and said retaining member are each approximately 5 inches in length and said handguard is approximately ½ inch in length.

* * * * *